US005655342A

United States Patent [19]

Guillemet et al.

[11] Patent Number: 5,655,342

[45] Date of Patent: Aug. 12, 1997

[54] SHIMMING DEVICE FOR LEVEL ADJUSTMENT AND ANCHORING OF WINDOW FRAME IN A WALL OPENING

[75] Inventors: Guy Guillemet, Terrebonne; Martin Tremblay, Laval; Yvon Soucy, St-Sulpice, all of Canada

[73] Assignee: Idematech International Inc., Laval, Canada

[21] Appl. No.: 352,370

[22] Filed: Dec. 9, 1994

[51] Int. Cl.[6] ..... E06B 1/04

[52] U.S. Cl. ..... 52/217; 52/126.1; 49/505

[58] Field of Search ..... 52/126.1, 126.3, 52/126.5, 126.6, 217, 213, 204.56; 248/188.2, 188.3; 49/505

[56] References Cited

U.S. PATENT DOCUMENTS

| | | | |
|---|---|---|---|
| 3,553,891 | 1/1971 | Casebolt et al. | 52/217 X |
| 3,570,203 | 3/1971 | Williams | 52/217 |
| 3,571,996 | 3/1971 | Braswell | 52/217 |
| 4,637,183 | 1/1987 | Metz | 52/127 |
| 4,870,791 | 10/1989 | Nelson | 49/505 X |
| 5,063,638 | 11/1991 | Howard et al. | 52/217 X |

*Primary Examiner*—Kien T. Nguyen

[57] ABSTRACT

A shimming device for installation and level adjustment of a frame in an opening of a wall structure is described. The device comprises a housing securable in a space defined between the opening of the wall structure and an outer surface of the frame. A leaf spring is secured in the housing and a bolt fastener causes the spring to extend out of the housing and retract therein. The spring, when in its extended condition from the housing, engages a surface adjacent the space. The frame is held in securement and is level-adjusted in the opening by opposed shimming devices secured in opposed spaces defined between the opening and the frame. It is pointed out that no screws are inserted through the frame for its securement in the opening. The device may also be comprised of a leaf spring which is actuable by a strapping element which is securable to the surrounding structure.

30 Claims, 9 Drawing Sheets

SHIMMING DEVICE FOR LEVEL ADJUSTMENT AND ANCHORING OF WINDOW FRAME IN A WALL OPENING

TECHNICAL FIELD

The present invention relates to a shimming device for installation and level adjustment of a frame, particularly, but not exclusively, a window or door frame, being mounted in an opening of a wall structure.

BACKGROUND ART

The conventional method of mounting a frame, such as a window or a door frame, within an opening of a wall structure is to position the frame within the opening which is made slightly larger than the outer periphery of the frame and the level thereof is then adjusted by securing wooden shims, usually cedar shingle pieces which vary in thickness from end to end, within the space around the frame. These shingle pieces are usually longer than the width of the frame and need to be cut flush with the frame after these have been installed and the frame is leveled. It is thereafter necessary to secure the window frame to the opening in the wall structure, and this is done by inserting fasteners, such as nails or screws, within the frame from the outside and into the peripheral members forming the wall structure. The fasteners then have to be concealed by paint or otherwise.

A disadvantage of this conventional method is that it is time consuming, and these shingles also cause problems. For example, because the shingles extend across the frame, it is very difficult to provide a uniform caulking seal about the frame. It is also not possible to provide a continuous insulation about the periphery of the frame in the exterior region thereof, between the frame and the opening, as the shingles present an interference. Furthermore, when constructing housing structures the wooden material utilized is usually not completely dry, and after a year or more these wooden pieces utilized in the construction of a wall structure will twist and change positions thereby causing variations in the space between the frame and the opening. Such movement in the structural materials will cause voids about the shingles, and this will result in causing the caulking to crack in the area of the shingles and air will infiltrate. Furthermore, the space defined about the window frame and the opening in the wall structure will vary somewhat causing the window frame to de-level itself. This would then cause a further disadvantage in that the window panes will not slide effectively if the frame becomes unleveled. It is also pointed out that when the window frame is shimmed with wooden pieces, any movement in the wall structure about the frame will be transferred directly to the frame of the window by the fasteners, and this can lead to deformation of the frame, rendering the window pane inoperable and often causing the glass pane to crack or break. The fasteners will also crack the frame and become unsightly.

The process of leveling the windows by using wooden shingle shims is also time consuming, and often there is insufficient number of shims, or the shims are placed in improper areas to provide for an efficient window or door frame installation.

In order to remedy this problem shimming devices have been developed but have not heretofore been adequate to resolve the above-mentioned problems. A typical example of such shim device is described in U.S. Pat. No. 3,571,996 wherein the device provides an adjustment by means of a screw which is accessible from the exterior of the frame.

SUMMARY OF THE INVENTION

It is a feature of the present invention to provide a shimming device which substantially overcomes the above-mentioned disadvantages of the prior art.

Another feature of the present invention is to provide a shimming device for level adjustment, anchoring and installation of a window or door frame in an opening of a wall structure and wherein the shimming device is installed on the outer periphery of the window frame and is connectable, by means of a strap, to adjacent surfaces of the wall structure defining the opening.

Another feature of the present invention is to provide a shimming device for level adjustment and anchoring of a window or door frame wherein the adjustments are provided by screws which are accessible in the space defined between the frame and the opening in the wall structure and wherein no fasteners are inserted in the frame.

Another feature of the present invention is to provide a shimming device for level adjustment and anchoring of a frame in an opening of a wall structure wherein the shimming device will remain in position regardless of whether or not the framing material of the wall structure displaces itself over time and wherein the shimming device provides for the positioning of continuous insulation in at least the exterior and interior peripheral regions of the space between the frame and the wall opening and substantially in the entire space defined thereacross.

Another feature of the present invention is to provide a shimming device for level adjustment and anchoring of a frame in an opening of a wall structure wherein the housing of the device is made of a non-thermally conductive material which utilizes a leaf spring biasing element that is maintained in compression to compensate for any variations in said space over time.

Another feature of the present invention is to provide a shimming device for level adjustment of a window or door frame to be mounted in an opening of a wall structure wherein a plurality of such devices are mounted on the frame which permit quick level adjustment as well as lateral adjustment of the frame within the opening and securement thereof to the surrounding structure.

Another feature of the present invention is to provide a shimming device for level adjustment and anchoring of a window or door frame wherein the device is integrally formed within the frame.

Another feature of the present invention is to provide a shimming device which is comprised of a leaf spring which is securable to an abutment edge of a frame and actuable by a strapping element which is securable to the surrounding structure.

According to the above features, from a broad aspect, the present invention provides a shimming device for level adjustment and anchoring of a frame in an opening of a wall structure. The device comprises a housing securable in a space defined between the opening of the wall structure and an outer surface of the frame. Expansion means is secured in the housing. Adjustable means is provided for causing the expansion means to extend out of the housing and retract therein. The expansion means when extended from the housing engages a surface adjacent the space. The frame is held in securement and is level adjusted in the opening by opposed shimming devices secured in opposed spaces defined between the opening and the frame.

According to a still further broad aspect of the present invention there is provided a shimming device for level adjustment of a frame in an opening of a wall structure. The device comprises expansion means securable in a space defined between the opening of the wall structure. Adjustable means is provided for causing the expansion means to expand in the space. The expansion means, when expanded, engages an adjacent surface in the space. The frame is held in securement and is level adjusted in the opening by opposed shimming devices secured in opposed spaces defined between the opening and the frame.

According to a still further broad aspect of the present invention the expansion means of the shimming device is a leaf spring having a securable end and a free end. The leaf spring has a bolt section extending from the free end to the securable end. An aperture is provided in the bolt section adjacent the securable end. The adjustable means is a strap element secured at the leaf spring free end and extends under the bolt section and through the aperture. The strap element has a securable free end. The bolt section is expanded by a pulling force exerted on the strap element from the securable free end. The strap element has arresting means to engage an abutment means of the spring element to maintain a predetermined pulling force on the strap element.

According to a still further broad aspect of the present invention the strap element is integrally formed with the leaf spring from a suitable plastics material, such as acetal plastics.

BRIEF DESCRIPTION OF DRAWINGS

A preferred embodiment of the present invention will now be described with reference to the accompanying drawings in which.

Figure 5:
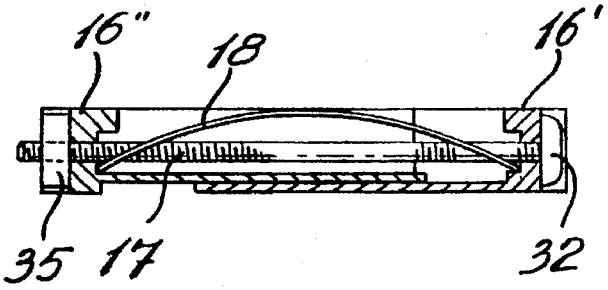
Figure 6:
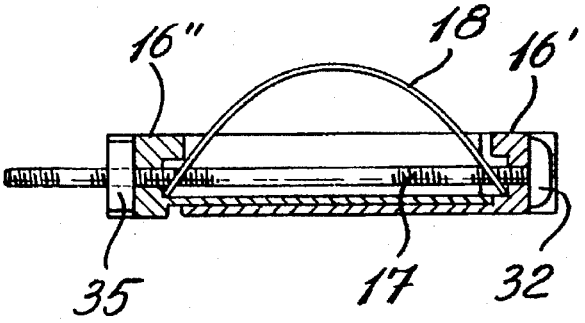
Figure 7:
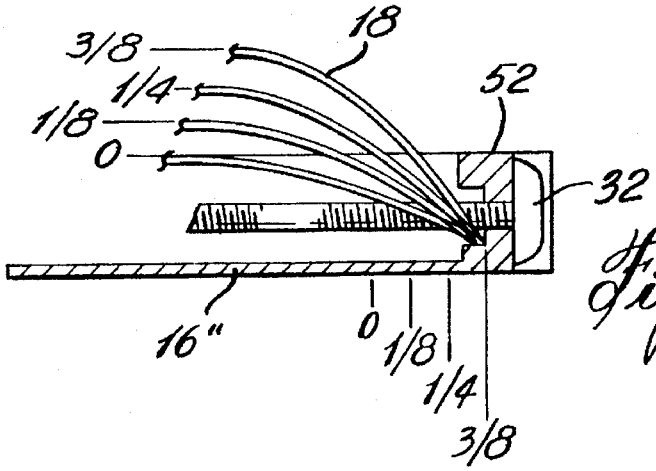
Figure 8:
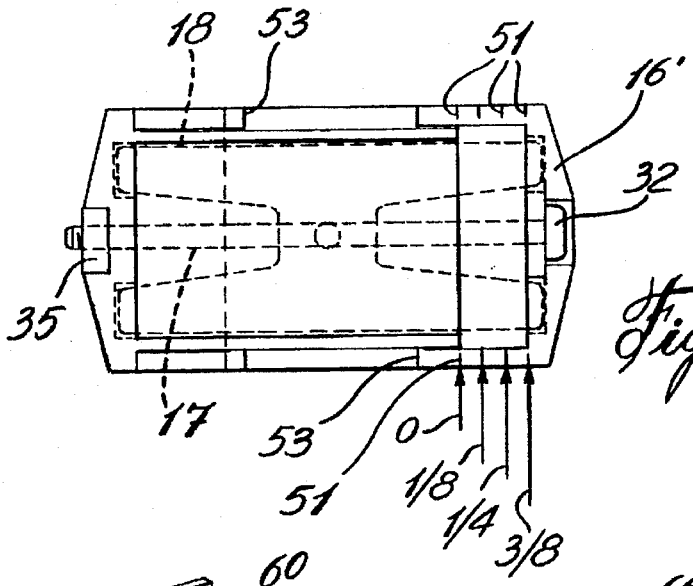
Figure 9:
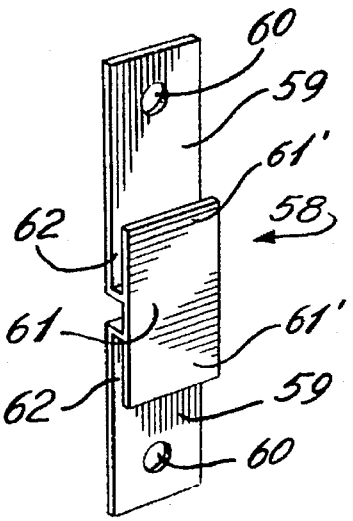
Figure 10:
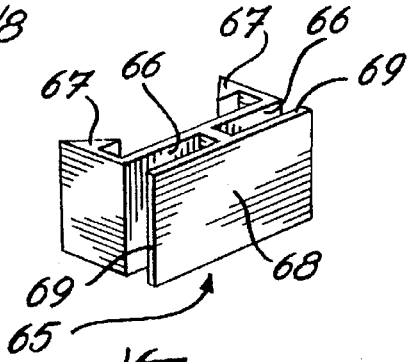
Figure 11:
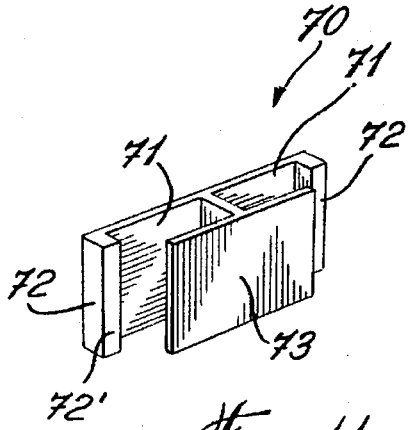
Figure 12:
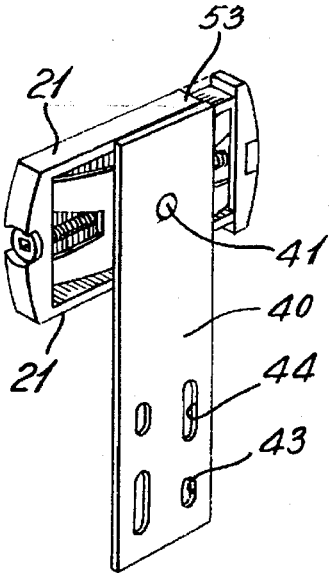
Figure 13A:
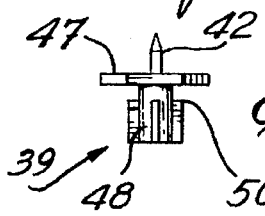
Figure 13B:
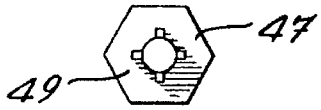
Figure 14:
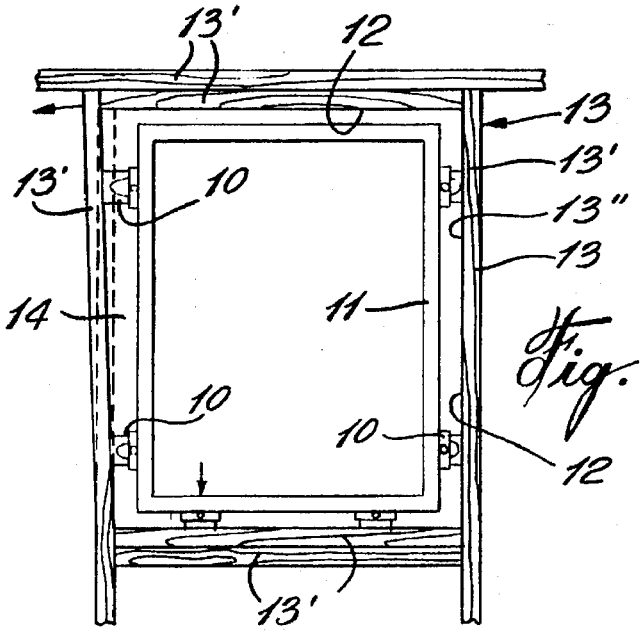
Figure 15:
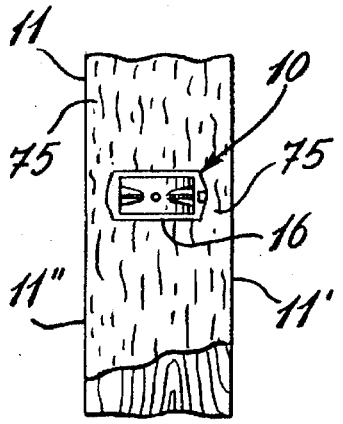
Figure 16A:
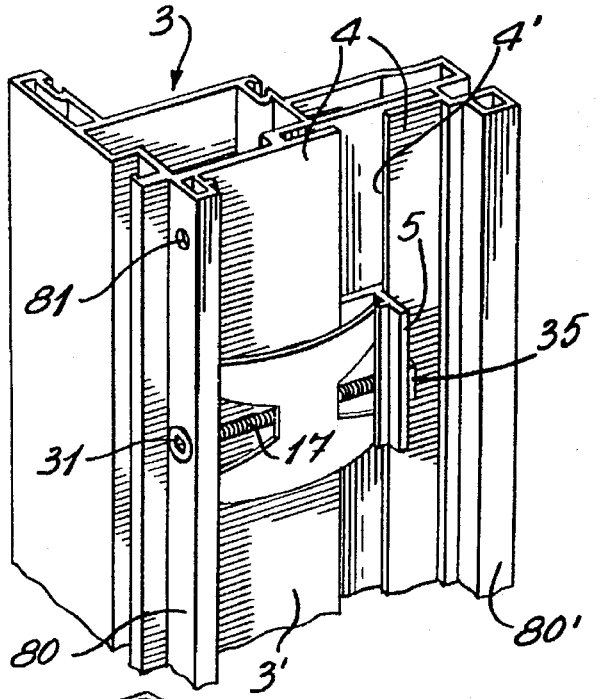
Figure 16B:
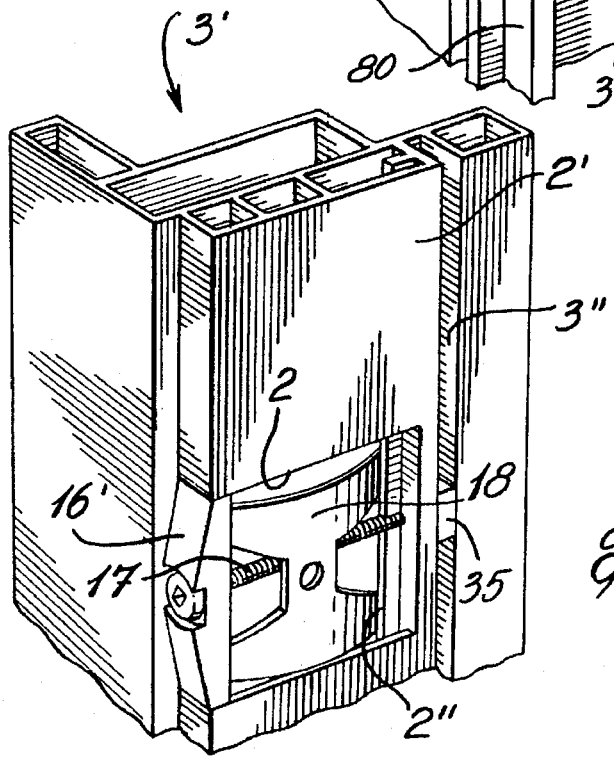
Figure 17A:
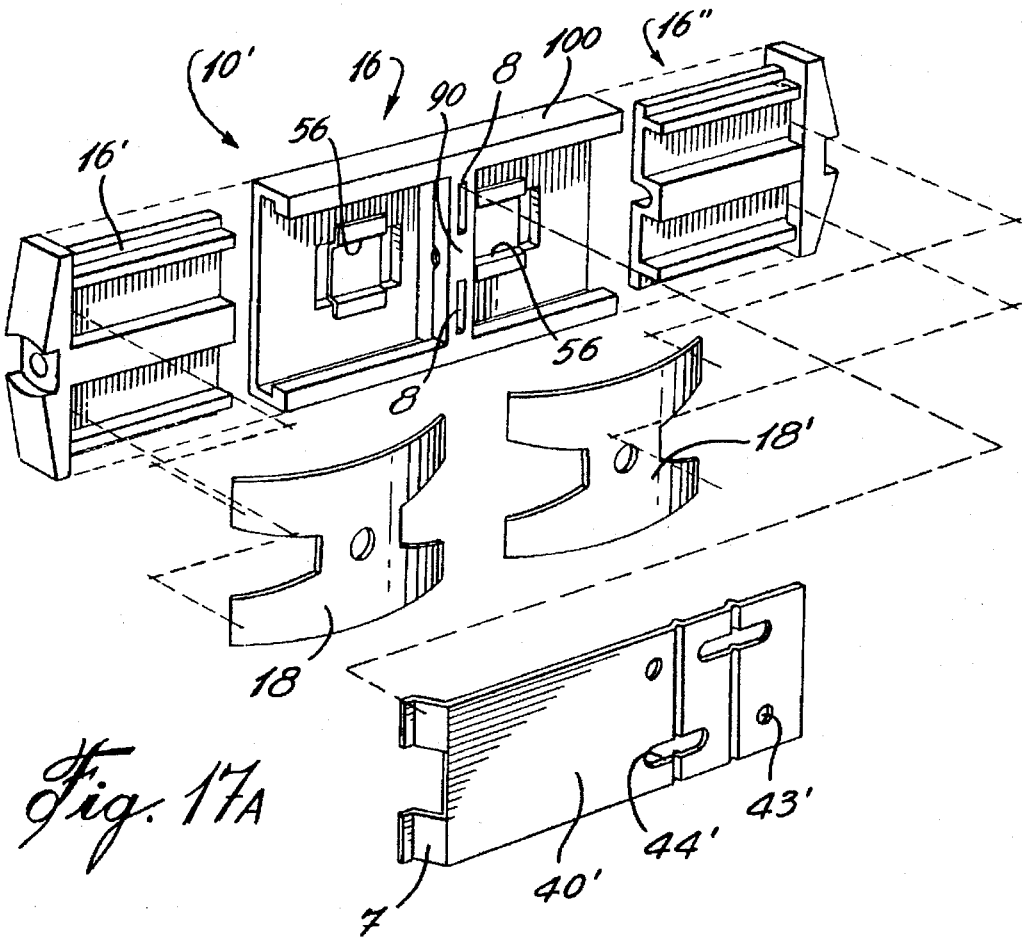
Figure 17B:
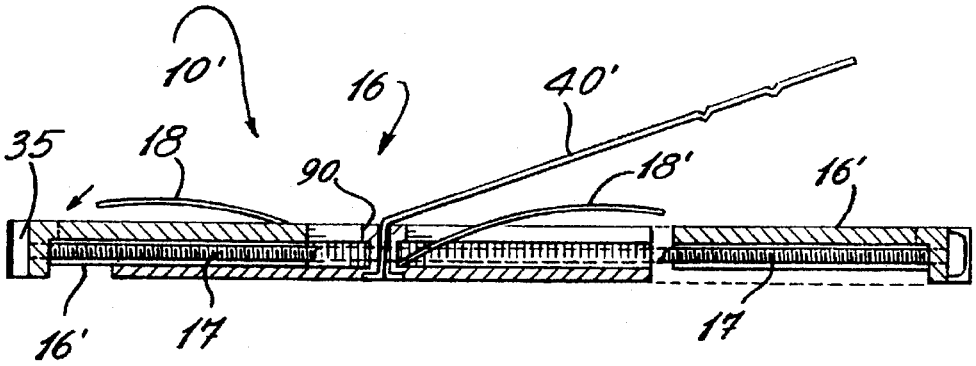
Figure 18A:
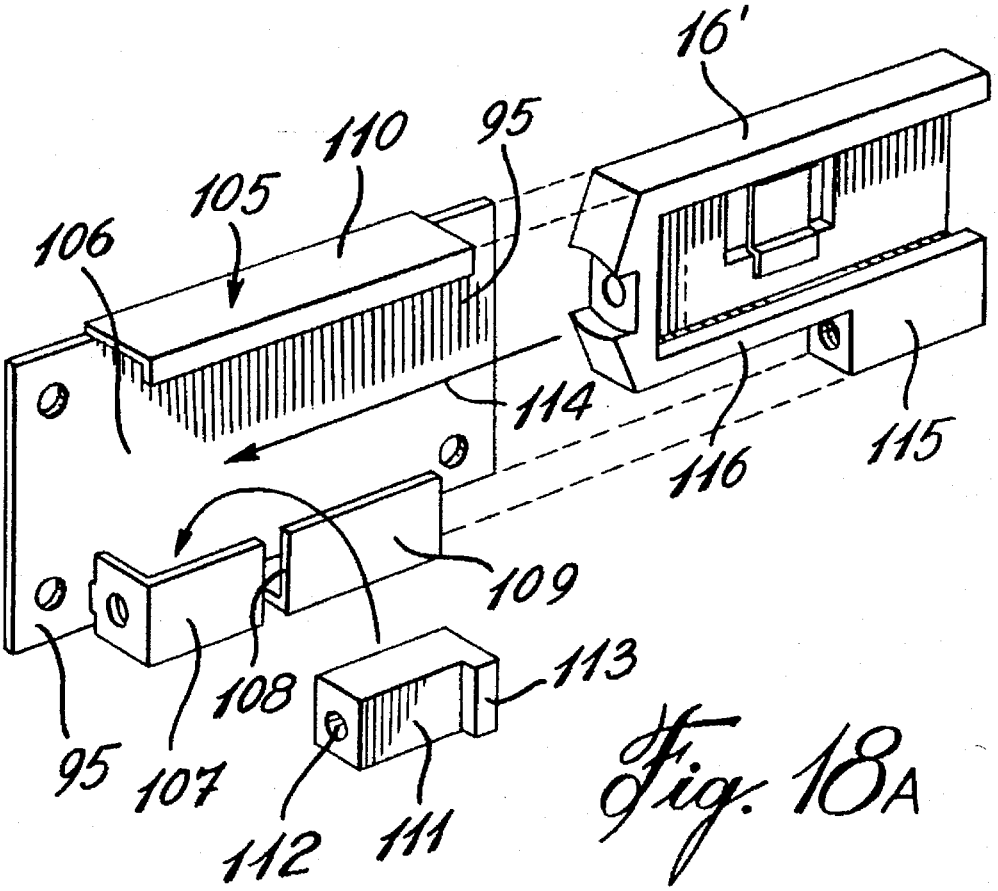

FIG, 4 is a further plan view of the other section of the two-section housing;

FIG. 5 is a simplified side section view showing the operation of the shimming device of the present invention prior to expansion of the leaf spring;

FIG. 6 is a view similar to FIG. 5 showing the leaf spring in a substantially fully extended condition;

FIG. 7 is a fragmented sectional side view showing the displacement of the gradient of expansion of the leaf spring;

FIG. 8 is a top view of the shimming device the gradient of which indicates the expansion and compression of the leaf spring;

FIG. 9 is a perspective view of a clip fastener for anchoring the housing of the shimming device to a wooden frame;

FIG. 10 is a perspective view showing the construction of a further clip fastener for securing the housing of the shimming device to an aluminum extruded frame;

FIG. 11 is a perspective view of a still further clip fastener for anchoring the housing of the shimming device to a plastic extruded frame;

FIG. 12 is a perspective view showing a strap connector secured to the leaf spring of the shimming device for connecting the device to the surface of the framed opening and showing a raised wall thereof to hold the strap in pivoted position;

FIG. 13A is a side view of an arresting connector to secure the strap connector to the leaf spring and having an outer piercing element;

FIG. 13B is a bottom view of the arresting connector;

FIG. 14 is a schematic exaggerated representation showing how the shimming device of the present invention maintains a frame level within an opening after the space defined by the opening undergoes distortion;

FIG. 15 is a simplified schematic fragmented view showing the position of the shimming device with respect to the frame and insulation positioned thereabout;

FIG. 16A is a perspective view showing a shimming device integrally formed within an extruded plastic window frame;

FIG. 16B is a perspective view similar to FIG. 16A but showing another embodiment thereof;

FIG. 17A is a perspective exploded view showing a further modification of the shimming device of the present invention for securing wide door or window frames within a building opening and wherein two leaf springs are secured in a housing in side-by-side relationship;

FIG. 17B is a sectional side view of FIG. 17A in an assembled condition with the strap connector;

FIG. 18A is a perspective exploded view showing a still further modification of the shimming device of the present invention that allows transversal adjustment of the window.

Figure 18B:
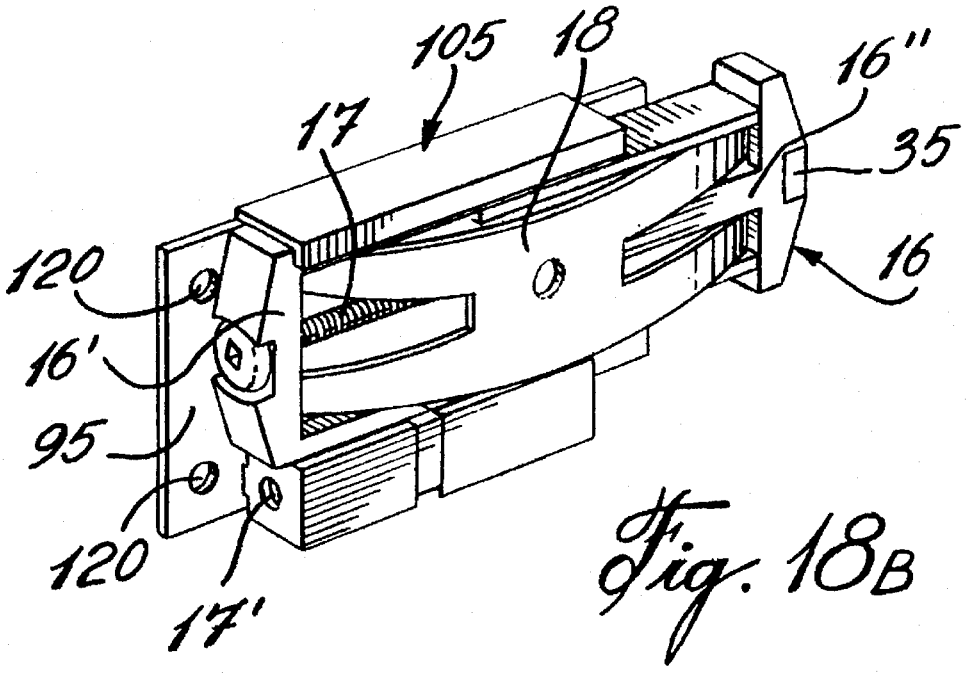
Figure 19A:
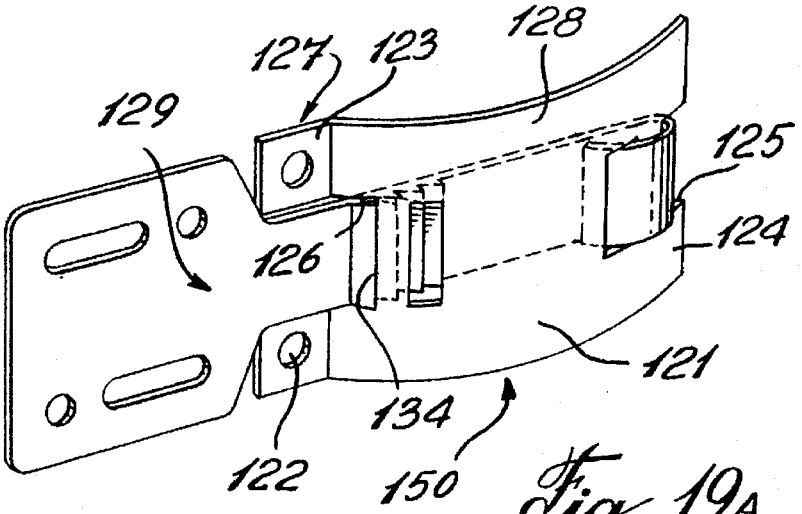
Figure 19B:
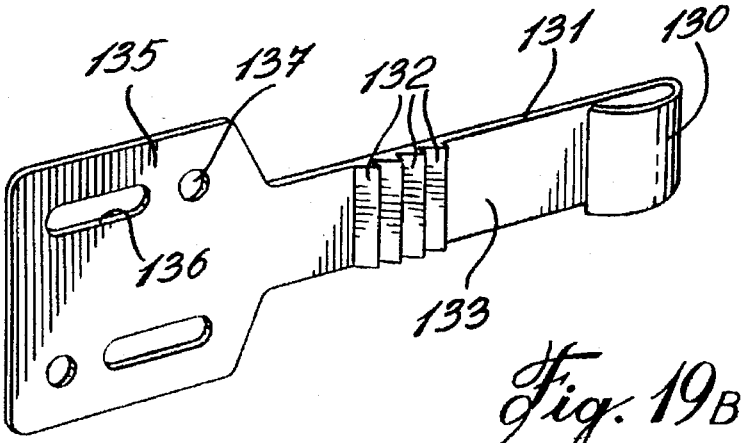
Figure 19C:
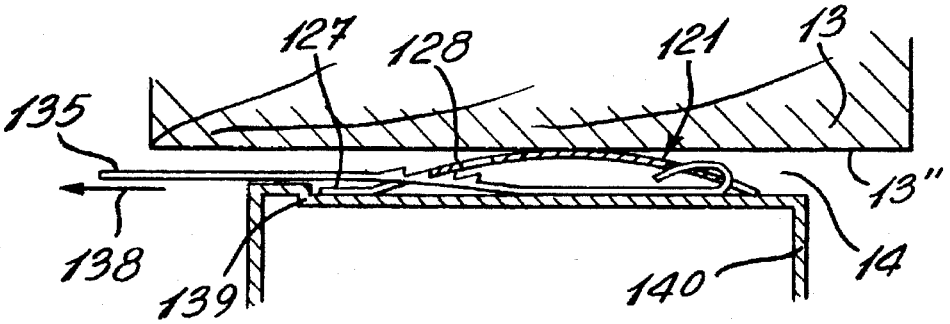
Figure 20A:
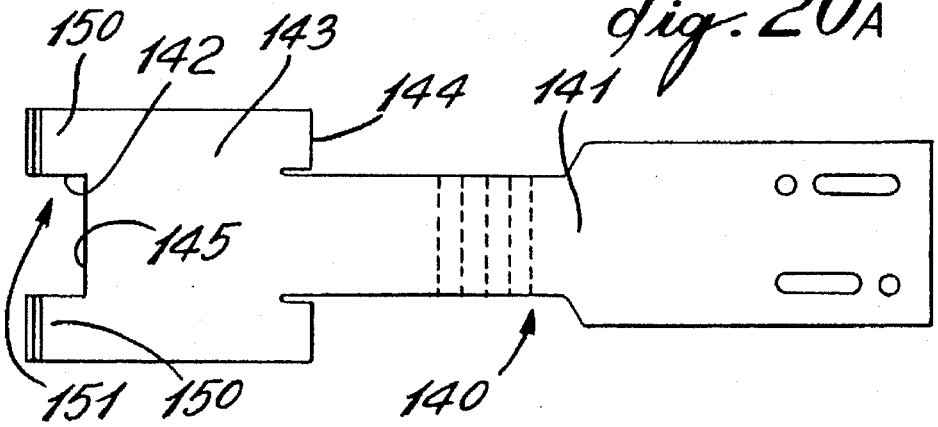
Figure 20B:
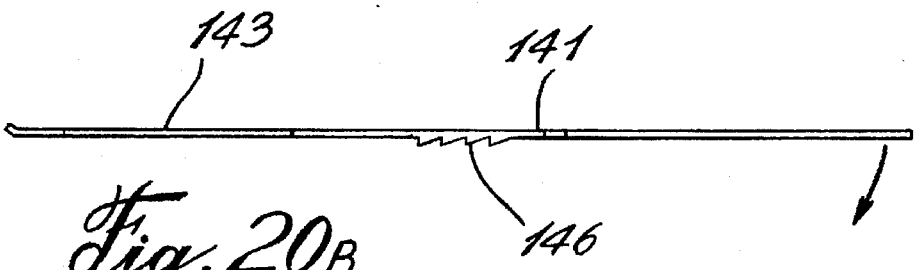
Figure 20D:
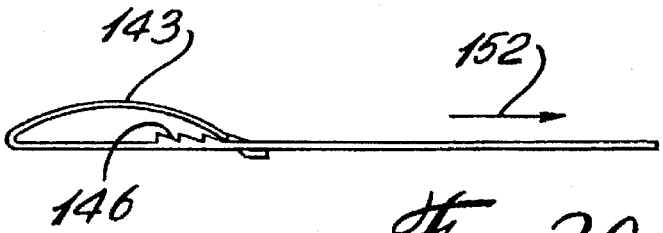
Figure 20C:
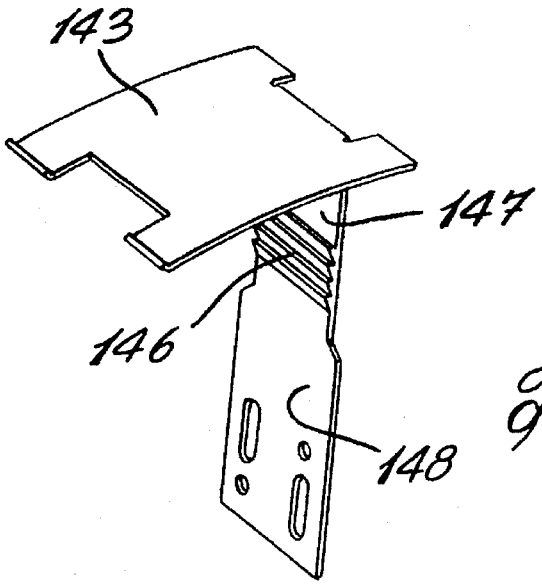

FIG. 18B is a perspective view showing the shimming device of FIG. 18A in an assembled condition;

FIG. 19A is a perspective view showing a still further embodiment of a shimming device consisting of a leaf spring and an actuable strapping element with the leaf spring being constructed for securement to a window frame;

FIG. 19B is a perspective view illustrating the construction of the strapping element;

FIG. 19C is a sectional side view showing the shimming device of FIG. 19A installed between a frame and a frame opening;

FIG. 20A is a plan view showing the construction of a modified shimming device as illustrated in FIG. 19A wherein the stripping element and the leaf spring are integrally formed from a plastics material;

FIG. 20B is a side view of FIG. 20A;

FIG. 20C is a perspective view showing the manner in which the strapping device is disposed relative to the leaf spring; and FIG. 20D is a side view illustrating the operation of the shimming device of FIG. 20A.

DESCRIPTION OF PREFERRED EMBODIMENTS

Figure 1:
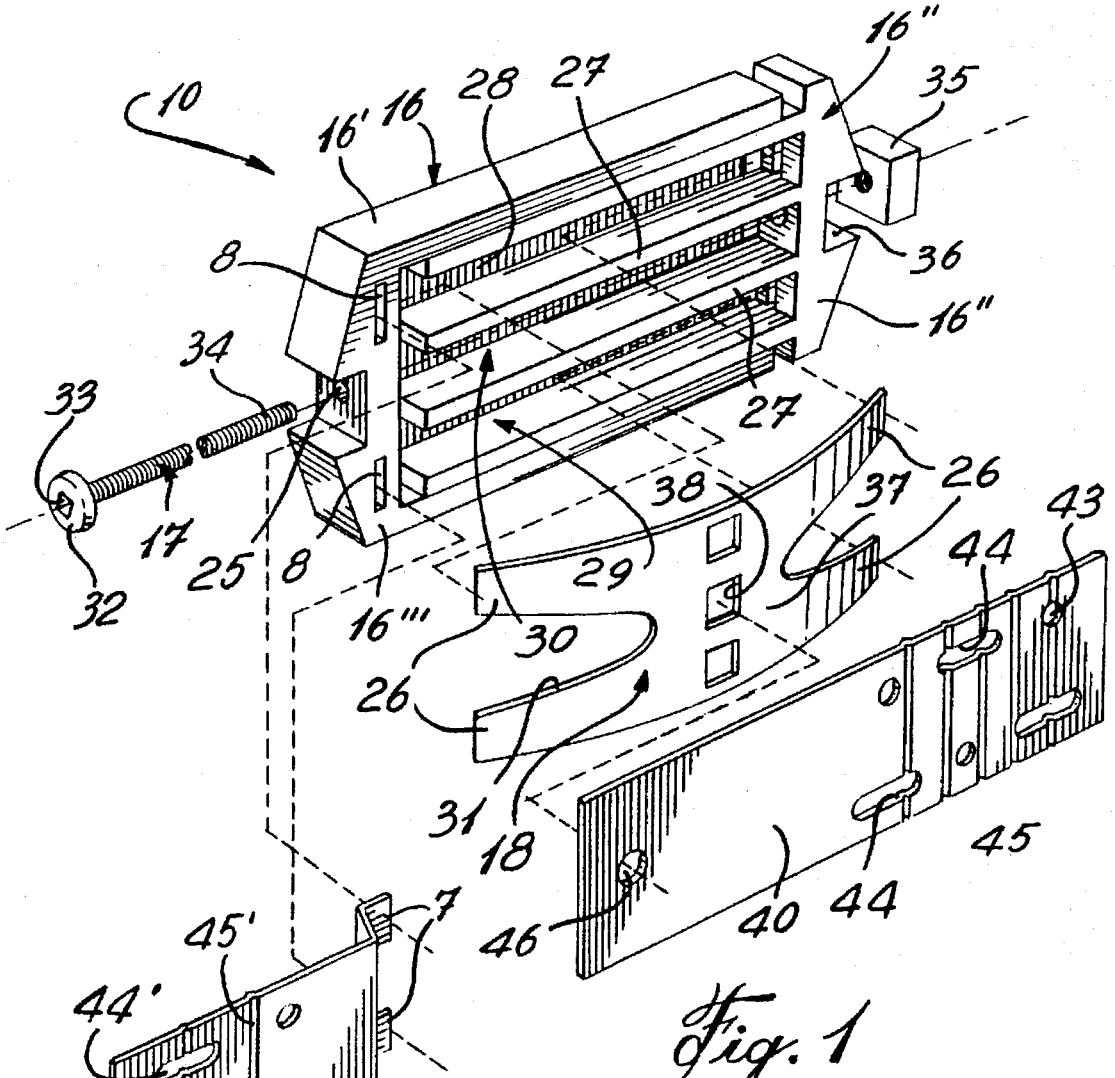
FIG. 1 is an exploded perspective view showing a shimming device constructed in accordance with the present invention with alternative anchoring strap connectors.

Referring now to the drawings, and more particularly to FIG. 1, there is shown the construction of a shimming device constructed in accordance with the present invention for level adjustments and anchoring of a frame in an opening of a wall structure. With additional reference to FIG. 14, there is shown a window frame 11 mounted in an opening 12 (herein the opening is shown exaggerated) of a wall structure 13. The wall structure 13 is that of a wooden building structure formed with framing studs 13', but it could also be a concrete structure with an anchor insert in the opening. As herein shown, a plurality of shimming devices 10, as shown in FIG. 1, is secured to the window frame and extends in the space 14 defined between the opening 12 and an outer surface 15 of the frame 11.

Figure 2:
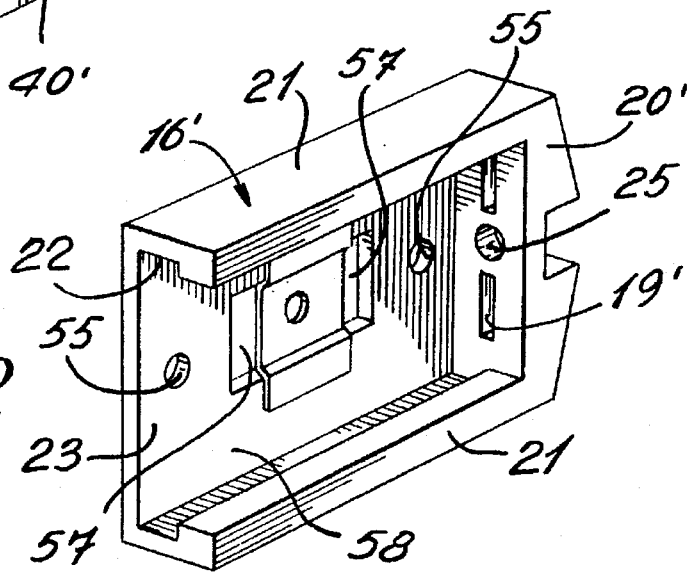
FIG. 2 is a perspective view showing one section of a two-section housing of the shimming device.
Figure 3:
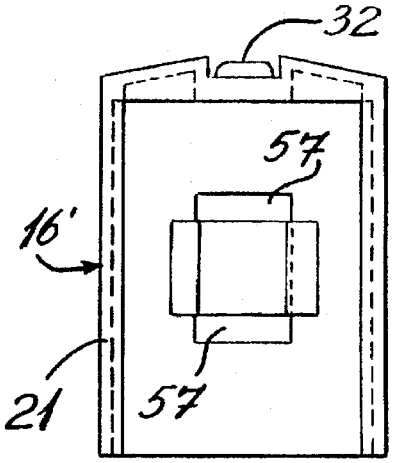
FIG. 3 is a plan view of FIG. 2.
Figure 4:
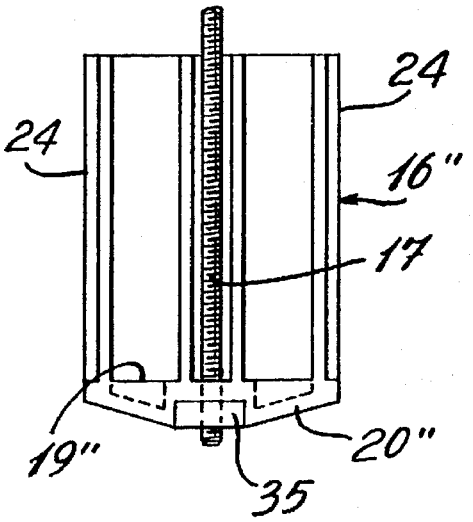

As shown in FIGS. 1 to 6, the shimming device 10 has a housing 16 formed by a first housing section 16' and a second housing section 16" which are interconnected in sliding fit by an adjustment bolt 17 which constitutes an adjustable means for causing a leaf spring 18, which is secured in the housing 16 to extend or bow out of the housing and to retract it therein. As shown in FIGS. 2, 3 and 4, each of the housing sections 16 and 16" is provided width retention means in the form of slots 19' and 19" which are provided in end walls 20' and 20" of housing sections 16' and 16" respectively, for receiving the legs 26 of the spring 18. The side walls 21 of the housing section 16' are also provided with undercut slots 22 which face inwardly of the housing section 16' and disposed immediately above the bottom wall 23 of the housing section 16'. The other housing section 16" is provided with side flanges 24 for sliding fit retention within the undercut slots 22. Through bores 25 and 25' are provided respectively in the end walls 20' and 20" for the passage of the bolt 17.

As shown in FIG. 1, the leaf spring 18 is an H-shaped stainless steel spring (SS B01 FH), a carbon spring steel heat-treated after machining and which defines a pair of spaced apart legs 26 at opposed ends thereof. The spring is also bow-shaped for extension above the ribs 27 formed in the top face 28 of the bottom wall 29 of the housing section 16". The ribs 27 define a central channel 30 therebetween through which the bolt fastener 17 extends for connecting the two housing sections 16' and 16" together and for compressing the spring. However, before the sections are connected together the legs 26 of the leaf spring 18 are disposed within the retention slots 19' and 19" formed in the end walls 20' and 20" of the housing sections 16 and 16". Such position is illustrated in FIG. 5. The spring 18 also defines a U-shaped cavity 31 between the legs at opposed ends thereof. These cavities 31 permit the passage of the bolt fasteners 17 therethrough when in the position as shown in FIG. 5.

As also shown in FIG. 5, it can be seen that the bolt fastener 17 is provided with a head 32 having a tool engaging cavity 33, herein a cavity to be engaged by a screwdriver, to impart axial rotation of the bolt. The free end 34 of the bolt is threadably received within a nut 35 which is held captive within a cavity 36 formed in the end wall 20" of the housing section 16". Accordingly, as shown in FIG. 6, when the bolt is axially rotated in a specified direction, it will cause the end walls of the housing sections to move closer to one another applying compression from opposed ends of the spring causing it to bow out of the housing. The central portion 37 of the leaf spring 18 is also provided with a square hole 38 to receive an arresting connector 39 therein (see FIGS. 13A and 13B) to pivotally secure a strap connector 40 thereto.

The strap connector 40 is provided for securing the spring member and consequently the housing and the frame to the adjacent surface 13" of the framing studs 13' which forms the opening 12. As can also be seen from FIGS. 13A and 13B, the arresting connector 39 is provided with an outer piercing element 42, and it also engages within the adjacent surface 13" of the framing stud 13'. The interconnection of the strap connector 40 to the surrounding structure 13 is effected after the window frame 11 has been leveled within the opening 12. This is done by inserting fasteners in the holes 43, 44 of the straps 40.

There are preferably, as shown in FIG. 14, two shimming devices connected spaced apart to the vertical side walls of the frame and two to the bottom horizontal side wall. Additional shimming devices may also be connected to the top vertical wall of the frame. By rotating the bolt head 32 the leaf springs are caused to extend out of the housing and engage with the adjacent surface 13" of the framing studs 13' until the frame is leveled. These bolts are tightened such that the leaf spring is placed in compression within the space or opening 14 thereby exerting a compression force between the surface 13" of the framing studs 13' and the outer surface 15 of the frame. Accordingly, it can be seen that the frame is connected within the opening without the use of fasteners extending through the frame member and into the framing studs, as is customary in the prior art. In this case the fasteners engage the studs from the inside of the opening when fasteners extend through plastic frames. There is substantial expansion and contraction in the plastic with change in temperature, and the plastic will crack where the fasteners are connected.

The strap connector 40 is provided with holes 43 and slots 44 throughout an end section thereof and a plurality of spaced apart transverse weakened slots 45 are provided to break off sections of the straps which extend inwardly of the framing studs 13' on the inside of the frame. The other end of the strap is provided with a hole 46 to receive the arresting connector 39, as shown in FIG. 13, to secure same to the square hole 38 formed in the central portion 37 of the leaf spring 18.

The housing 16 may also have in the end wall 16"' and on an outer surface thereof rectangular undercut retention cavities 8 for attaching therein the strap connector 40' instead of strap 40. This strap connector 40' is provided with legs 7 at an end thereof which are received captive within these retention cavities 8. The strap, as herein shown, is also provided with slots 44' and holes 43' for attaching same to an adjacent structural member of the opening. The strap 40' may also be provided with transverse weakened slots 45' to segment the straps so that they do not exceed the inner side edge of the window opening.

As shown in FIGS. 13A and 13B, the arresting connector 39 has a flange head 47 above which the piercing element 42 extends. The arresting connector has a stem section 48 and retention ribs 39 for securing under the leaf spring 18. A space 50 is defined under the flange at 47 to receive the strap 40 in pivotal retention therein. It is also within the ambit of the present invention that the arresting connector 39 be utilized solely as a connector means to interconnect the housing or the leaf spring to which it is secured thereto directly to the surrounding frame structure of the opening. When the leaf spring is expanded within the space to be placed into compression, the piercing element 42 of the connector 39 would engage within the surrounding frame structure to interconnect and arrest the frame from lateral displacement. Accordingly, it provides an anchoring means between the frame, via the shimming device, and surrounding the structure of the opening.

Referring now to FIGS. 7 and 8, it can be seen that one of the housing sections, herein section 16', may be provided with gradient markings 51 adjacent an end thereof which indicates the distance that the leaf spring 18 extends above the top wall 52 of the housing. This is particularly advantageous when the housing is mounted to the frame whereby the spring can be extended out of the frame at a certain distance, before installation, so that the frame can be positioned in snug friction fit within the frame opening 12 prior to the leveling thereof. This greatly accelerates the level and connection of the frame within the opening as the installer needs only then to adjust the bolts slightly to level the frame. In other words, prior to installation the installer would, for example, cause all of the springs to extend a predetermined common distance from the housings. The advantage of the pivotal connection between the spring, which is secured to the housing and the strap connector, is that after installation the housing can be displaced with respect to the frame by expansion and contraction of the frame.

FIG. 12 shows a further modification of the housing wherein a raised wall section 53 is formed in opposed top edges of the side walls 21 of the housing section to arrest the strap connector 40 thereacross while being pivoted at 41 for installation. Accordingly, the straps do not extend outside the frame before installation. This is particularly useful when the device 10 is pre-installed in the frames, as shown in FIGS. 16A and 16B.

As shown in FIG. 2, the rear or bottom wall 23 of the housing section 16' may be provided with screw receiving holes 55 to secure the housing to the outer surface 15 of a wooden frame 11. As also shown in FIG. 2, this rear or bottom wall 23 may also be provided with a square hole cavity 56 having opposed rectangular depressions 57 on the inner surface 58 of the bottom wall for receiving therein clip fasteners as shown in FIGS. 9 to 11. As shown in FIG. 9, one of the clip fasteners, herein fastener 58, is a plastic or metal connector of substantially rectangular configuration and having opposed wings 59 having holes 60 therein for receiving fasteners (not shown) to secure the connector 58 to an outer surface of a wooden frame. An elevated rectangular rib 61 extends above the wings 59 and defines opposed connecting slots 62 thereunder. The housing 16' is secured to the rectangular rib 61 by inserting the rib through the rectangular connecting cavity 56 in the rear or bottom wall 23 thereof and rotating the housing 16' whereby the opposed ends 61' of the rib 61 are received within the depressions 57 adjacent the cavity 56.

FIG. 10 shows another type of clip fastener 65 also formed of plastics or metal material and for anchoring or for snap retention within extrusion rails 4 (see FIG. 16A) formed in the outer surface of an extruded frame 3, herein a PVC frame. This connector is provided with wings 66 having gripping flanges 67 at the free end thereof to grip these rails. It also has an elevated rectangular rib 68 with opposed undercut channels 69 for retention within the rectangular cavity 56 in the rear or bottom wall 23 of the housing 16.

FIG. 11 shows a still further clip fastener 70 for anchoring to plastic extruded frame members. As herein shown the wings 71 are provided with inwardly facing clamping flanges 72 extending towards the elevated rectangular rib 73 which is secured to the housing in a similar fashion as the clip fasteners of FIGS. 9 and 10, with the exception that the rear wall of the housing is received between the rear face of the elevated rectangular rib 73 and the end faces 72' of the flanges 72. The rear wall 74 is then snap fitted in friction retention within the channel of the extrusion.

As can be seen from FIG. 15, the housing 16 is dimensioned such that it is spaced from the outside wall surface 11' and inside wall surface 11" of the frame 11 whereby insulation 75 can be positioned in the spaces all about the frame and the framing studs. There is therefore no conductive element nor any obstruction element, as is the case with the shingle shimming technique of the prior art, extending to the outside wall or surface 11'. With this connector, as previously described, it is not necessary to apply fasteners through the frame to secure it to the framing studs of the opening as this is done by the strap connector 40, 40'.

Referring to FIG. 16A, there is shown an extruded plastic window frame 3 wherein the shimming device 10 is installed directly within the side wall 3' of the frame 3 between the flange rib 80 and an insert connector 5 fitted in the slot 4'. Holes 81 are made through the rib 80 for inserting the bolt 17. The nut 35 is retained captive at the end of the connector 5. As the screw head is rotated by inserting a screwdriver through the hole 31, the connector 5 will move towards the head of the bolt and the leaf spring 18 will extend or bulge outwardly of the ribs 80, 80' to apply pressure against the surrounding structure.

FIG. 16B shows another embodiment of a shimming device integrally formed within the outer surface of an extruded window or door frame. As herein shown, a cavity 2 is machined in the outer surface 2' of the extruded frame 3' to receive therein the housing section 16'. The leaf spring 18 is held within the cavity 2 by abutment with an end wall 2" of the cavity. The nut 35 is retained within an extruded slot 3" of the frame. By rotating the bolt 17 the housing 16' will move inwardly of the cavity 2 causing the leaf spring 18 to expand out of the cavity 2 to apply pressure against the surrounding wall structure.

FIGS. 17A and 17B illustrate a still further embodiment wherein the housing 16, as herein shown, is an elongated housing adapted to receive a pair of leaf springs 18 and 18'. The housing casing 100 receives two housing sections 16" and is provided with a rib 90 at the center thereof for abutment and compression of the springs 18 and 18'. The operation of this embodiment of the shimming and attaching device 10' is obvious in view of the above description and it need not be repeated again. These elongated double spring shimming devices are particularly useful for shimming wide door frames.

FIGS. 18A and 18B shows a still further embodiment of the shimming device of the present invention Wherein the housing sections 16' and 16" are received within a bracket 105 with flange connectors 95 formed integrally in a rear wall 106 for securement to a frame side wall. A slide block retention flange 107 is secured to the bottom edge of the back wall 106 and has a vertical slot 108 in a side wall 109 extending in spaced parallel relationship to the back wall 106. A further slide retention flange 110 is provided in the top edge of the rear wall 106. A connector block 111 is received captive between the flange wall 109 and rear wall 106 of the bracket and is provided with a through bore 112 for the passage of the bolt 17' therethrough. A rib 113 is received within the slot 108 to arrest the block 111.

As shown in FIG. 18A, the housing section 16' is held captive between the flanges 110 and 109 and inserted from the rear end thereof in a direction of arrow 114. This housing section 16' is also provided with a block extension formation 115 in the bottom side wall 116 thereof. This formation 115 is aligned with the block 111 and engages the threaded shank (not shown) of the bolt 17'. The purpose of the bolt 17' is to provide lateral adjustment of the window or door frame within the surrounding opening.

As shown in FIG. 18B when the shimming device is assembled within the bracket 105, the housing section 16" and the leaf spring 18 are assembled in a conventional manner as above described and retained in position by the bolt 17. The bracket 105 is secured to the side wall of the window or door frame by inserting fasteners, such as screw fasteners, through the holes 120. The compression of the spring 18 is adjusted by rotating the bolt 17. If it is necessary to laterally displace the frame within the opening, this can be done, within a limited range, by rotating the bolt fastener 17' which causes the housing 16, including housing section 16' and 16" to be displaced laterally with respect to the bracket 105. Accordingly, there is provided lateral adjustment as well as leveling adjustment to the frame.

Referring now to FIG. 19A, there is shown the construction of a further shimming device embodying the principle of operation of the present invention. This shimming device 150 is comprised essentially of a leaf spring 121 which constitutes an expansion means and is securable in the space 14 about the frame 11, as shown in FIG. 14, and to either the frame or the window side by securing fasteners (not shown) through the holes 122 provided in the legs 123 formed at one end of the leaf spring 121. The other end of the spring is a free end 124 and is provided with a slot 125. A further aperture or slot 126 is provided in the bowed section 128 of the leaf spring between the legs 123 at the securable end 127.

With additional reference to FIGS. 19B and 19C, it can be seen that an adjustable means in the form of a strap element 129 is secured to the leaf spring free end 124 within the slot 125 therein by means of a hook end 130 engageable with the free end of the spring. The strap element has a narrow band section 131 which extends under the bolt section 128 of the spring and exits through the aperture 126. A plurality of transverse engaging ribs 132 is provided on the outer surface 133 of the band section 131 in a section thereof for abutment engagement with the arresting edge 134 of the aperture 126. The strap also has an enlarged securable free end 135 provided with one or more through bores 136 and 137 to receive fasteners therethrough to secure the strap free end 135 to an adjacent surface of the surrounding frame structure of the opening or to the frame side wall.

Referring now more specifically to FIG. 19C, it can be shown that in operation the bolt section 128 of the spring is caused to bow out by pulling on the enlarged section 135 of the strap element in the direction of arrow 138 causing the spring to bow out and apply pressure against the surrounding surface 13" of the wooden frame 13. As also shown in FIG. 19C, the securable end 127 of the spring 121 needs only to abut against an edge, herein edge 139, of an extruded frame member 140 and fasteners may not be required to secure the leaf spring to any of the adjacent surfaces in the opening 14 defined between the surrounding structure of the opening and the frame 140. In the embodiment above described the leaf spring is formed of stainless steel while the strapping element 129 is a plastic molded element. Of course, it could also be stamped and formed from metal.

Referring now to FIGS. 20A to 20D, there is shown a further embodiment of the shimming device 120, as shown in FIG. 19A. As herein shown, the shimming device 140 is formed entirely of a plastic material, such as acetal, and may be injection-molded. As herein shown, the strapping element 141 is formed integral within the free end 144 of the spring element 143. An aperture 142 having an abutment edge 145 is also provided. Arresting ribs 146 are also molded in the narrow strap section 147 of the strap. The enlarged free end 148 is also provided with holes 149 for the securement thereof. The legs 150 at the securable end 151 of the spring formation 143 are also adaptable for retention against a rib, such as the rib 80 shown in FIG. 16A of an extruded frame member 3. By pulling the strap in the direction of arrow 152, the spring section 143 is caused to bow outwards, as shown in FIG. 20D. The ribs or teeth 146 provided in the strapping section engage with the abutment edge 145 and retain the bolt spring section 143 in expansion and compression within the space.

It is within the ambit of the present invention to cover any obvious modifications of the examples of the preferred embodiment described herein, provided such modifications fall within the scope of the appended claims. It is pointed out that the wall structure may be formed with metal studs or be a solid concrete wall with window and door openings therein.

We claim:

1. A shimming device adapted for level adjustment and anchoring of a frame in an opening of a wall structure, said device comprising a housing securable in a space defined by an opening between a wall structure and an outer surface of a frame when disposed in said space, expansion means secured in said housing, adjustable means for causing said expansion means to extend out of said housing and retract therein, said housing being a two-section housing with each section interconnected in sliding fit by said adjustable means, each said section having retention means for engaging a respective one of opposed ends of said expansion means, said retention means of said two housing sections being displaced to and away from one another by said adjustable means to cause said expansion means to extend out of said housing or retract therein, said expansion means when extended from said housing engaging a surface adjacent said space, connector means adapted to connect said housing to an adjacent surface of a wall structure when disposed in said space, said shimming devices when disposed in opposed one of said spaces being engaged in said space by actuating said adjustable means to cause said expansion means to extend out of said housing to provide level adjustment of a frame in said space defined by an opening.

2. A shimming device as claimed in claim 1 wherein there are two or more shimming devices adapted to be secured spaced apart on a respective one of said opposed spaces.

3. A shimming device as claimed in claim 2 wherein said opposed shimming devices are adapted to be secured in opposed vertical spaces defined between said opening and said frame and wherein at least two of said shimming devices are adapted to be secured in a bottom opening thereof, said frame being a rectangular window frame.

4. A shimming device as claimed in claim 1 wherein said housing is adapted to be secured to a frame disposed in said space by fastener members.

5. A shimming device as claimed in claim 1 wherein said housing sections each have an end wall and opposed side walls, one of said sections being received in the other sections with said side walls in sliding fit retention, said adjustable means being a threaded bolt fastener retaining said sections together, said sections retaining a leaf spring which biases said sections away from one another, said leaf spring constituting said expansion means.

6. A shimming device as claimed in claim 5 wherein said leaf spring is retained captive between said end walls of said housing sections by said retention means.

7. A shimming device as claimed in claim 6 wherein said leaf spring is an H-shaped steel spring defining a pair of spaced apart legs at opposed ends thereof, a cavity formed at said opposed ends between said legs, said bolt fastener extending through holes formed centrally in said end walls and aligned with said U-shape cavities under said leaf spring, each free end of said opposed ends being received in a retention cavity formed in said end walls of said housing sections and constituting said retention means.

8. A shimming device as claimed in claim 7 wherein said bolt fastener has a tool engaging head at one end thereof and a nut in threaded engagement at another end, one of said end walls of said housing sections having a nut receiving cavity to immovably retain said nut therein.

9. A shimming device as claimed in claim 1 wherein one of said housing sections has a rear wall for receiving one or more screw fasteners to secure said housing to an outer surface of a frame disposed in said space.

10. A shimming device as claimed in claim 1 wherein one of said housing sections has a cavity therein to receive a clip fastener adapted to secure said housing to an outer surface of a frame disposed in said space.

11. A shimming device as claimed in claim 10 wherein said clip fastener is an anchor having wings with snap fasteners for snap retention to extrusion rails formed in said outer surface of an extruded frame, and a connector for securement to said cavity of said one of said housing sections.

12. A shimming device as claimed in claim 11 wherein said clip fastener is a connector having wings for receiving fasteners to secure same to said outer surface of a frame, and a connector for securement to said cavity of said one of said housing sections.

13. A shimming device as claimed in claim 1 wherein said connector means is a securing element is adapted to interconnect said expansion means to a surface of said wall structure.

14. A shimming device as claimed in claim 13 wherein said connector means is an arresting connector secured to said expansion means and having a piercing element to engage said surface when said expansion means is extended in compression within said space.

15. A shimming device as claimed in claim 1 wherein said connector means is a strap connector secured to said expansion means for connection of said housing to a surface of a wall structure defining said opening, the wall structure being a wooden frame structure.

16. A shimming device as claimed in claim 15 wherein said expansion means is a leaf spring, said strap connector being secured to said leaf spring by an arresting connector having an outer piercing element for engagement in said wooden frame when said leaf spring is extended out of said housing.

17. A shimming device as claimed in claim 15 wherein said strap connector is a flat rectangular metal strap having a plurality of transverse weakened slots to permit detachment of sections of said strap connector after installation securement of said strap to said surface of a wall structure, and openings in said metal strap to receive fasteners for the securement of said strap to a surface of said wall structure to connect a frame in an opening of said wall structure.

18. A shimming device as claimed in claim 17 wherein said metal strap is pivotally connected to said leaf spring by said arresting connector.

19. A shimming device as claimed in claim 1 wherein the frame is a window or a door frame.

20. A shimming device as claimed in claim 1 wherein said retention means is a bolt fastener secured between a pair of flange connectors, each said flange connectors being formed integrally with a respective one of said sections of said housing and in a common side wall thereof.

21. A shimming device as claimed in claim 1 wherein said housing is adapted to be secured to said outer surface of said frame by fasteners, said expansion means when extended to an engaging position being secured to a surface of said wall structure defining said opening by an arresting connector.

22. A shimming device as claimed in claim 1 wherein there is further provided lateral adjustment means for displacing said frame laterally within said opening after said frame has been leveled and anchored within said opening.

23. A shimming device as claimed in claim 1 wherein said expansion means is a leaf spring having a securable end and a free end, said leaf spring having a bowed section extending from said free end to said securable end, an aperture in said bowed section adjacent said securable end, said adjustable means being a strap element secured at said leaf spring free end and extending under said bowed section and through said aperture, said strap element having a securable free end, said bowed section being expanded by a pulling force exerted on said strap element from said securable free end, said strap element having arresting means to engage with an abutment means of said spring element to maintain a predetermined pulling force on said strap element.

24. A shimming device as claimed in claim 23 wherein said strap element is a separate element having engaging means at said free end.

25. A shimming device as claimed in claim 24 wherein said engaging means is a hook end formation to engage said free end of said bowed section.

26. A shimming device as claimed in claim 23 wherein said leaf spring is a steel spring, said arresting means of said strap element being a plurality of engaging ribs formed on a surface of said strap element in a section thereof for abutment engagement with an arresting edge of said aperture.

27. A shimming device as claimed in claim 23 wherein said leaf spring is a plastic spring element, said strap element being integrally formed with said leaf spring and extending from said free end thereof, said arresting means of said strap element being a plurality of engaging ribs formed on a surface of said strap element in a section thereof for abutment engagement with an arresting edge of said aperture.

28. A shimming device as claimed in claim 26 or 27 wherein said securable free end is provided with one or more through bores for receiving one or more fasteners therethrough to secure said strap free end to said adjacent surface in said space.

29. A shimming device as claimed in claim 23 wherein said securable end of said leaf spring is an abutment end for abutting engagement with an arresting edge of a formation in a side wall of a window or door frame.

30. A shimming device as claimed in claim 23 wherein said securable end of said leaf spring is provided by one or more through bores for receiving one or more fasteners therethrough to secure said strap free end to a side wall of a window or door frame.

* * * * *